United States Patent [19]

Harding

[11] Patent Number: 4,804,096

[45] Date of Patent: Feb. 14, 1989

[54] TAMPER RESISTANT CONTAINER

[76] Inventor: Claude J. Harding, 3520 E. Cannon Dr., Phoenix, Ariz. 85028

[21] Appl. No.: 184,978

[22] Filed: Apr. 22, 1988

[51] Int. Cl.[4] ..... B65D 51/24

[52] U.S. Cl. ..... 215/228

[58] Field of Search ..... 215/228, 334, 100 R

[56] References Cited

U.S. PATENT DOCUMENTS

| | | | |
|---|---|---|---|
| D. 291,179 | 8/1987 | Frizon | D9/371 |
| 2,361,423 | 10/1944 | Snyder | 41/10 |
| 3,099,452 | 7/1963 | Fernicola | 273/199 |
| 3,129,528 | 4/1964 | Gausewitz | 46/178 |
| 3,765,995 | 10/1973 | Perrin | 161/18 |
| 3,978,232 | 8/1976 | Doddsworth et al. | 416/115 |
| 4,021,519 | 5/1977 | Krueger et al. | 264/96 |
| 4,669,621 | 6/1987 | Steigerwald et al. | 215/228 |
| 4,717,032 | 1/1988 | Wu | 215/228 |

*Primary Examiner*—George T. Hall

*Attorney, Agent, or Firm*—Cahill, Sutton & Thomas

[57] ABSTRACT

A tamper resistant container includes a container having a hollow body and a removable cap. In a normal position, the mouth of the container body is threadably secured to a mated threaded section of the cap and the entire assembly is maintained in an upright position by an underlying load support surface. In an inverted position, the container body is detached from the container cap and inverted such that the opposite end of the container body is placed within an unobstructed interior cavity formed in the cap. In this configuration, the cap supports the container body with the open mouth of the container body exposed to permit access to the interior of the container.

14 Claims, 2 Drawing Sheets

TAMPER RESISTANT CONTAINER

BACKGROUND OF THE INVENTION

1. Field of the Invention

This invention relates to containers having removable caps, and more particularly to containers having removable caps where the cap of said container is also capable of supporting a removable container body section.

2. Description of the Prior Art

Medication is frequently packaged and stored in containers manufactured from disposable plastic materials. Such medication containers typically include both a plastic cap as well as a plastic container body section. Significant and highly dangerous acts of tampering have occurred with such medication container configurations because such containers incorporate a flat bottom surface at the end of the container opposite the cap end of the container. Such flat container bottom surfaces serve as the load supporting base for the container and are essentially obstructed from view by the consumer.

A significant number of instances have arisen where such prior art medication containers have been removed from drug stores. Tampering is then accomplished by cutting away from flat base of the container at a location in proximity to the location where the base of the container joins the vertical sidewalls of the container. The flat base of such prior art containers can easily be cut away from the body of the container, completely exposing the contents of the container. Tampering can then be accomplished. As a result of the clean, linear separation made between the flat container base and the container body, the container base can be glued back to the container body. Any rough, exposed edges of the reglued container base/container sidewall joint can be sanded away such that detection of such tampering is exceedingly difficult even when accomplished by skilled drug company inspectors. Because the container base is covered by the opaque medication or other product within the container, evidence of tampering on the container base is not visible to the consumer.

Because a factory seal can readily be affixed to the threaded coupling between the container cap and the mouth of the container itself, this portion of such prior art medication containers is relatively tamper proof in comparison to the highly susceptible flat base of such prior art containers.

SUMMARY OF THE INVENTION

It is therefore a primary object of the present invention to provide a tamper resistant container having a base formed from the container cap, by placing the cap at what would normally be the bottom of a container.

Another object of the present invention is to provide a tamper resistant container having an end opposite to the cap end of the container which possesses no flat or linear surface area subject to tampering.

Another object of the present invention is to provide a tamper resistant container having a cap which both seals the contents of the container and forms a base for the container after the cap has been removed from the container.

Another object of the present invention is to provide a tamper resistant container which can be supported by a cap, whether the container body is positioned in a normal or in an inverted position.

Briefly stated, and in accord with one embodiment of the invention, a container includes a hollow body with a continuous thin wall surface symmetrical with respect to a longitudinal axis extending through the center of an open mouth. The mouth of the container body is located at a first end of the body with the second end defined by the intersection of the longitudinal axis with the surface of the body. The mouth of the container body includes an exterior surface having a threaded cap engagement surface. The surface of the container body further includes a load transfer surface located in proximity to the second end of the body. The load transfer surface extends symmetrically with respect to the longitudinal axis of the container around the surface of the container. The container body is positionable either in a normal position or in an inverted position. A removable cap includes a cylindrical disc section with substantially flat, unobstructed parallel first and second surfaces. A wall extends outward from the first surface of the disc section and includes an end and a substantially cylindrical threaded surface. The threaded surface secures the cap to the cap engagement surface of the mouth. The wall of the cap further includes a body support surface for engaging the load transfer surface of the container body when the container is in the inverted position as well as for maintaining the container in the inverted position with the cap removed from the mouth of the body. The body support surface of the cap transfers the weight of the container body from the container mouth through the cap to an underlying support surface when the container is in the normal position. The mouth of the container may therefore be secured to and supported by the cap when the container is in the normal position. The body support surface of the cap contacts the load transfer surface of the container when the container is in the inverted position thereby transferring the weight of the container through the cap to the underlying load support surface.

DESCRIPTION OF THE DRAWINGS

The invention is pointed out with particularly in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a number of preferred hardware embodiments of the invention will now be described in detail.

Figure 1:
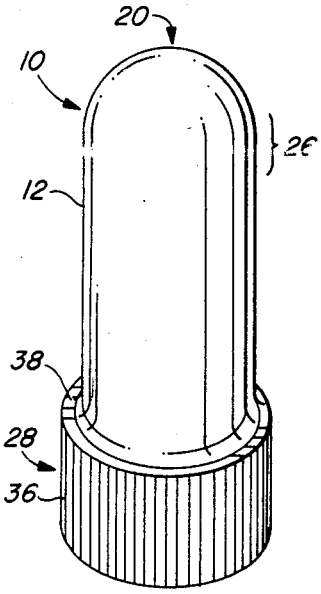
FIG. 1 is a perspective view of one embodiment of the invention shown in the normal position.
Figure 3:
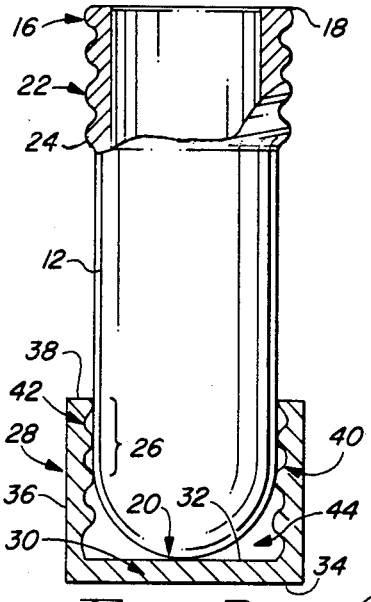
FIG. 3 represents a sectional view of the FIG. 1 embodiment of the invention shown in the inverted position.
Figure 4:
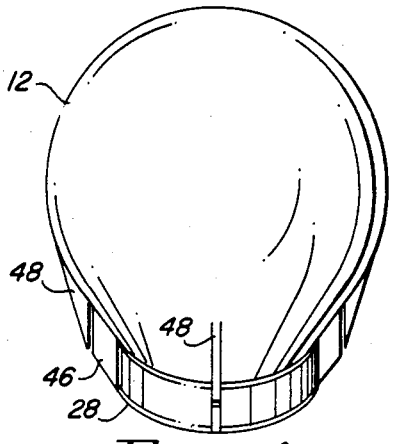
FIG. 4 represents a perspective view of another embodiment of the invention shown in the normal position.
Figure 2:
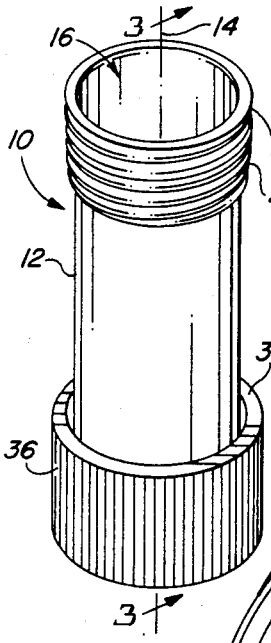
FIG. 2 represents a perspective view of the FIG. 1 embodiment of the invention shown in the inverted position.

Referring now to the embodiment illustrated in FIGS. 1, 2 and 3, a container 10 includes a hollow body 12 with a thin wall surface (see FIG. 3) symmetrical with respect to a longitudinal axis 14 as illustrated in FIG. 2. Longitudinal axis 14 extends through the center of an open mouth 16 located at a first end 18 of body 12. A second end 20 is defined by the intersection of longitudinal axis 14 with the surface of body 12. Mouth 16 includes an exterior surface 22 having a threaded cap engagement surface 24.

The surface of body 12 further includes a load transfer surface 26 which in the FIG. 3 embodiment of the invention takes the form of a cylindrical section having a predetermined length along body 12. As illustrated in FIG. 3, load transfer surface 26 is located in proximity to second end 20 of body 12 and extends symmetrically with respect to longitudinal axis 14 of container body 12.

In FIG. 1, container 10 is shown in a normal position. In FIGS. 2 and 3, container 10 is shown in the inverted position.

A removable cap 28 includes a cylindrical disc section 30 having substantially flat, unobstructed parallel first and second surfaces designated respectively by reference numbers 32 and 34.

A wall 36 extends outward from the first surface 32 of cap disc section 30 and includes an end 38 as well as a substantially cylindrical threaded surface 40 which secures cap 28 to the cap engagement surface 24 of mouth 16.

Wall 36 of cap 28 further includes a body support surface which is depicted in FIG. 3 as the area of threaded surface 40 of cap 28 which overlaps with the load transfer surface 26 of container body 12 and is generally designated by reference number 42. Body support surface 42 engages the load transfer surface 26 of container body 12 when container 10 is in the inverted position depicted in FIG. 3. As illustrated in FIG. 3, body support surface 42 maintains container body 12 in the inverted position with cap 28 removed from mouth 16 of body 12 and transfers the weight of container body 12 from mouth 16 through cap 28 to an underlying support surface such as a shelf (not shown) when container body 12 is in the normal position depicted in FIG. 3.

As illustrated in FIG. 1, mouth 16 of container body 12 is secured to and supported by cap 28 when container body 12 is in the normal position. When the container body 12 is in the inverted position illustrated in FIGS. 2 and 3, body support surface 42 of cap 28 contacts the load transfer surface 26 of container body 12 and transfers the weight of container body 12 through cap 28 to the underlying support surface.

Figure 16:
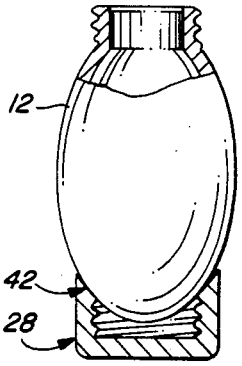
FIG. 16 represents a partially cutaway elevational view of the FIG. 15 embodiment shown in the inverted position.
Figure 17:
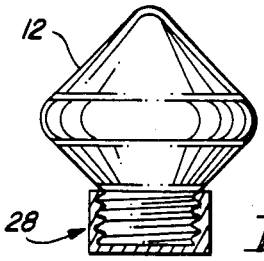
FIG. 17 represents a partially cutaway view of another embodiment of the invention shown in the normal position.
Figure 18:
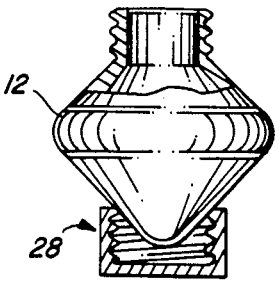
FIG. 18 represents a partially elevational view of the FIG. 17 embodiment of the invention shown in the inverted position.

As illustrated in FIG. 3, second end 20 of container body 12 extends below the end 38 of cap wall 36 when body 12 is placed in the inverted position. The wall 36 and disc 30 sections of cap 28 define an unobstructed, open interior chamber designated generally by reference arrow 44, a substantial portion of which is occupied by the penetration of the end 20 of body 12 below the top and into the interior of cap 28. For this reason, it is important that the cylindrical disc section 30 of cap 28 be formed with a substantially flat, unobstructed first surface 32 and that the interior side surfaces of wall 36 of cap 28 similarly remain substantially unobstructed. As illustrated in FIG. 3, this particular embodiment of the invention permits the end 20 of container body 12 to penetrate so completely into interior chamber 44 that end 20 actually contacts and is supported by the first surface 32 of cap disc section 30. Although this particular geometric relationship is not necessary as is illustrated the embodiments shown in FIGS. 10, 16 and 18, the end 20 of container body 12 will always penetrate well into interior chamber 44 with the end 20 of container body 12 penetrating a significant distance below the end 38 of cap wall 36.

Figure 7:
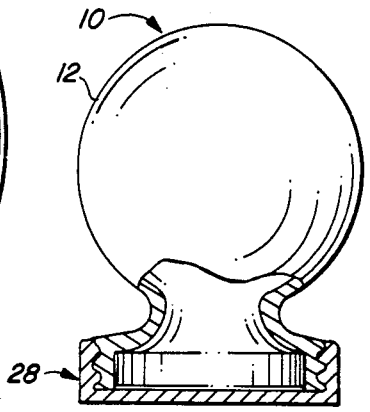
FIG. 7 represents a partially cutaway elevational view of another embodiment of the invention shown in the normal position.
Figure 8:
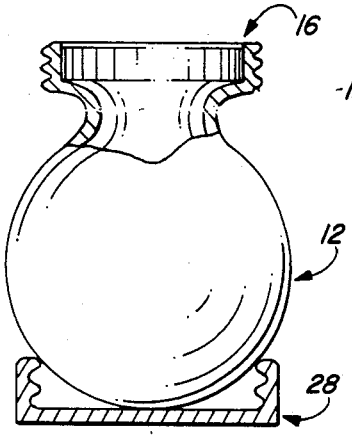
FIG. 8 represents a partially cutaway elevational view of the FIG. 7 embodiment of the invention shown in the inverted position.

In the FIGS. 1–3 embodiment of the invention, the width or diameter of interior chamber 44 is equal to or slightly greater than the diameter of cylindrical body 12. In the alternative body of the invention depicted in FIGS. 7 and 8, the diameter of interior chamber 44 is slightly less than the maximum diameter of container body 12. In other embodiments of the invention illustrated for example in FIGS. 9, 11, 15 and 17, the diameter of interior chamber 44 is significantly less than the maximum diameter of container body 12. As is readily evidenced from a review of all of the various different embodiments of the invention, the diameter of interior chamber 44 is always at least about equal to one half of the maximum diameter of container body 12 and in many instances is substantially greater than this minimum dimension.

Figure 11:
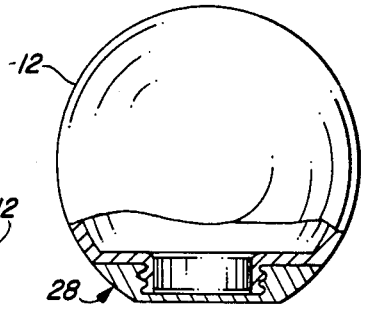
FIG. 11 represents a partially cutaway elevational view of another embodiment of the invention shown in the normal position.
Figure 12:
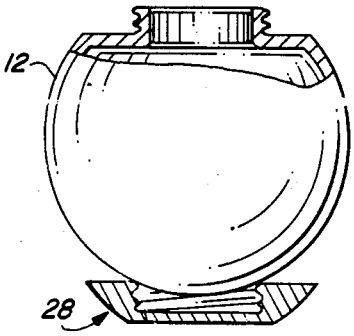
FIG. 12 represents a partially cutaway elevational view of the FIG. 11 embodiment of the invention shown in the inverted position.

In the embodiment of the invention illustrated in FIGS. 11 and 12, container body 12 takes the configuration of a substantially spherical body. The outer surface of wall 36 of cap 28 in this embodiment of the invention substantially completes the spherical section of container body 12. As is true with all embodiments of the invention, second surface 34 of disc section 30 creates a flat surface capable of forming a load supporting base for the container body 12 whether in the inverted or normal positions. Because of the somewhat lessened stability of this embodiment of the invention resulting from the decreased length of second surface 34, it may be appropriate to provide an additional ballast weight in the curved walls 36 of cap 28 to enhance the overall stability of this embodiment of the invention.

Figure 5:
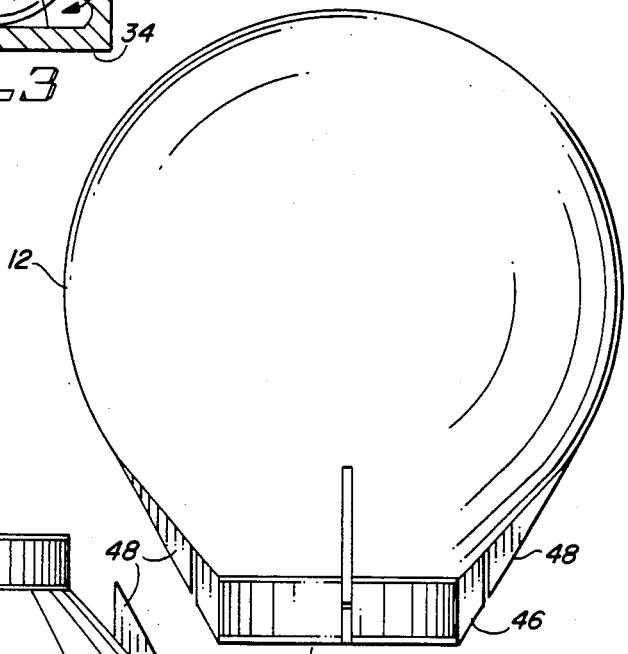
FIG. 5 represents an elevational view of the FIG. 4 embodiment of the invention shown in the normal position.
Figure 6:
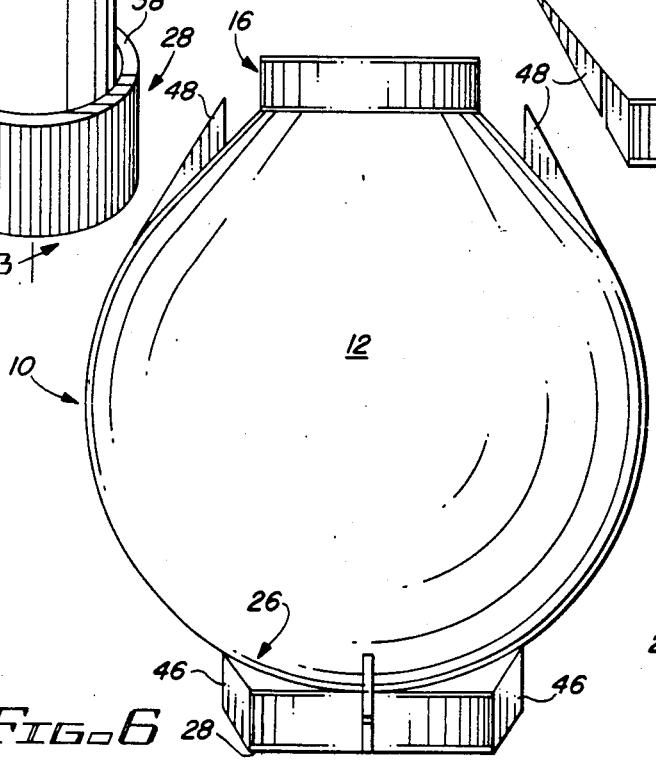
FIG. 6 represents an elevational view of the FIG. 4 embodiment of the invention shown in the inverted position.

The alternative embodiment of the invention illustrated in FIGS. 5 and 6, depicts the utilization of a plurality of vanes 46 extending from cap 28. A second plurality of vanes 48 extend radially outward from the exterior surface of body section 12 and are capable of being aligned with vanes 46.

The presence of vanes 46 and 48 substantially increases the difficulty of tampering with container 10 by requiring that each of the four vanes forming a set of vanes 46 and 48 be completely severed to permit container body 12 to be cut into two separable units to permit tampering. Since cap 28 is factory sealed to the mouth 16 of container body 12, the destruction of this factory seal by tampering need not be protected against by the present invention. When this embodiment of the invention is placed in the inverted position illustrated in FIG. 6, the upwardly extending vanes 46 form the body support surface 42 and engage with load transfer surface 26 forming a part of container body 12.

Figure 9:
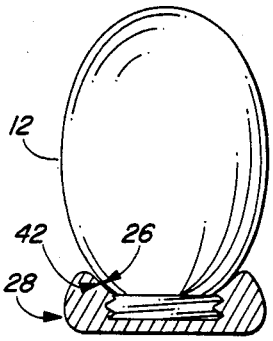
FIG. 9 represents a partially cutaway elevational view of another embodiment of the invention shown in the normal position.
Figure 13:
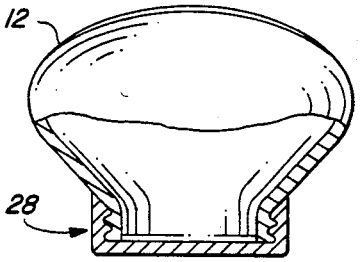
FIG. 13 represents a partially cutaway elevational view of another embodiment of the invention shown in the normal position.
Figure 14:
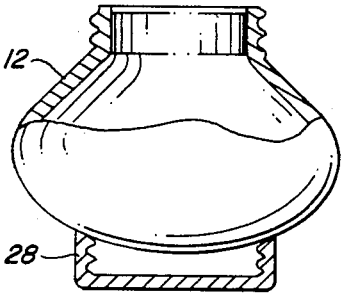
FIG. 14 represents a partially cutaway elevational view of the FIG. 13 embodiment of the invention shown in the inverted position.
Figure 10:
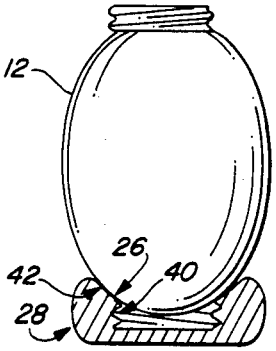
FIG. 10 represents a partially cutaway elevational view of the FIG. 9 embodiment of the invention shown in the inverted position.
Figure 15:
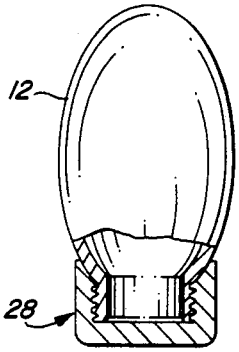
FIG. 15 represents a partially cutaway elevational view of another embodiment of the invention shown in the normal position.

In the alternative embodiment of the invention illustrated in FIGS. 9 and 10, the body support surface 42 of cap 28 is provided by an inclined surface which is mated to the curvature of the load transfer surface 26 of container body 12. A similar structural configuration of body support surface 42 is depicted in connection with the embodiment of the invention illustrated in FIGS. 15 and 16. In this embodiment of the invention, body support surface 42 of cap 28 is offset from threaded surface 40 while in the embodiment of the invention depicted in FIG. 3, these two surfaces overlapped.

Because the interior volume of a medication container is never completely filled with medication, a gap will remain between the upper surface of the medication and the second end of the container body. The combination of a transparent or translucent plastic container body wall with this cap readily exposes to view any tampering on this general area of container body 12. For example, with the FIG. 1 embodiment of the invention, medication may extend to a vertical elevation somewhere within load transfer surface 26 providing a gap between the medication and second end 20 of container body 12. This end 20 of container body 12 is normally stored in the position illustrated in FIG. 1 such that tampering on this part of the container may be readily viewed by the consumer. With prior art medication containers, the tamper susceptible flat base is typically located at the bottom of the container and obscured from view by the medication.

It will be apparent to those skilled in the art that the disclosed tamper resistant container may be modified in numerous ways and may assume many embodiments other than the preferred forms specifically set out and described above. Accordingly, it is intended by the appended claims to cover all such modifications of the invention which fall within the true spirit and scope of the invention.

I claim:

1. A tamper resistant container comprising:

a. container having a hollow body with a continuous thin wall surface symmetrical with respect to a longitudinal axis extending through the center of an open mouth located at a first end of said body with a second end defined by the intersection of the longitudinal axis with the surface of said body, said mouth including an exterior surface having a threaded cap engagement surface, the surface of said body further including a load transfer surface located in proximity to the second end of said body and extending symmetrically with respect to the longitudinal axis of said container around the surface of said container, said container being positionable in a normal position or in an inverted position; and b. a removable cap having a cylindrical disc section with substantially flat, unobstructed parallel first and second surfaces, a center, and a wall extending outward from the first surface of said disc section and including an end and a substantially cylindrical threaded surface for securing said cap to the cap engagement surface of said mouth, the wall of said cap further including a body support surface for engaging the load transfer surface of said body when said container is in the inverted position and maintaining said container in the inverted position with the cap removed from the mouth of said body and for transferring the weight of said container from the mouth through said cap to an underlying support surface when said container is in the normal position, wherein the mouth of said container may be secured to and supported by said cap when said container is in the normal position and wherein the body support surface of said cap contacts the load transfer surface of said container when said container is in the inverted position to transfer the weight of said container through said cap to said underlying support surface.

2. The container of claim 1 wherein the second end of said container body extends below the end of said cap wall when said container is in the inverted position.

3. The container of claim 2 wherein the wall and the disc section of said cap define an unobstructed, open interior chamber.

4. The container of claim 3 wherein the second end of said container body extends into the interior chamber of said cap when said container is in the inverted position.

5. The container of claim 4 wherein the second end of said body contacts the first surface of the disc section of said cap when said container body is in the inverted position.

6. The container of claim 4 wherein said cap includes ballast weight to increase the stability imparted to said container body by said cap when said container is in the first position.

7. The container of claim 4 wherein said cap further includes a plurality of vanes extending radially outwardly from the wall of said cap.

8. The container of claim 7 wherein the surface of said container body includes a plurality of radially spaced apart vanes located in proximity to the mouth of said body and aligned to mate with the vanes forming a part of said cap when said cap is secured to the mouth of said body.

9. The container of claim 8 wherein said cap includes at least four vanes and wherein the body includes at least four vanes.

10. The container of claim 4 wherein the body support surface of said cap forms a part of the threaded surface of said 11. The container of claim 4 wherein the body support surface of said cap is separated from the threaded surface of said cap.

12. The container of claim 4 wherein the second end of said container body is formed as a curved surface symmetrical with respect to the longitudinal axis.

13. The container of claim 4 wherein said container body includes a maximum diameter and wherein the diameter of said cylindrical disc of said cap is greater than half of the diameter of said container body.

14. The container of claim 13 wherein the diameter of the disc section of said cap exceeds the diameter of said body section.

* * * * *